US008459830B2

(12) United States Patent
Van Gorkom et al.

(10) Patent No.: US 8,459,830 B2
(45) Date of Patent: Jun. 11, 2013

(54) LIGHT OUTPUT DEVICE WITH PARTLY TRANSPARENT MIRROR

(75) Inventors: Ramon Pascal Van Gorkom, Eindhoven (NL); Arij Jonathan Rijke, Eindhoven (NL); Martin Jacobus Johan Jak, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 138 days.

(21) Appl. No.: 12/994,869

(22) PCT Filed: Jun. 5, 2009

(86) PCT No.: PCT/IB2009/052379

§ 371 (c)(1),
(2), (4) Date: Nov. 29, 2010

(87) PCT Pub. No.: WO2009/150586

PCT Pub. Date: Dec. 17, 2009

(65) Prior Publication Data

US 2011/0075420 A1 Mar. 31, 2011

(30) Foreign Application Priority Data

Jun. 10, 2008 (EP) ..... 08157934

(51) Int. Cl.
*F21S 8/02* (2006.01)
*F21V 7/22* (2006.01)
*F21V 7/06* (2006.01)

(52) U.S. Cl.
USPC ..... 362/217.17; 362/247; 362/296.09; 362/301; 362/311.11

(58) Field of Classification Search
USPC ..... 362/217.05, 217.06, 217.07, 231, 362/247, 296.01, 296.09, 296.1, 311.11, 362/341, 351, 223, 225, 235, 236, 237, 240, 362/241, 245, 249.02, 300, 301, 307
See application file for complete search history.

(56) References Cited

U.S. PATENT DOCUMENTS

| | | | | |
|---|---|---|---|---|
| 2,342,115 | A * | 2/1944 | Blauvelt | 362/247 |
| 2,556,690 | A * | 6/1951 | Guth | 362/225 |
| 5,895,128 | A | 4/1999 | Kishimoto et al. | |
| 6,045,243 | A | 4/2000 | Muth et al. | |
| 6,149,283 | A * | 11/2000 | Conway et al. | 362/236 |
| 7,145,125 | B2 * | 12/2006 | May et al. | 362/235 |
| 7,148,470 | B2 * | 12/2006 | Rains et al. | 362/235 |
| 7,234,820 | B2 | 6/2007 | Harbers et al. | |
| 7,239,449 | B2 | 7/2007 | Leitel et al. | |

(Continued)

FOREIGN PATENT DOCUMENTS

| | | |
|---|---|---|
| DE | 702556 | 2/1941 |
| WO | 0101188 A1 | 1/2001 |
| WO | 03048634 A1 | 6/2003 |
| WO | 2007016282 A2 | 2/2007 |

*Primary Examiner* — Ismael Negron
(74) *Attorney, Agent, or Firm* — John F. Salazar; Mark L. Beloborodov

(57) ABSTRACT

A light output device includes first and second light sources, and a partly transparent mirror arranged between the light sources. The partly transparent mirror, during operation, receives substantially all light emitted by the first and second light sources, and reflects part of the light emitted by the first light source and transmits part of the light emitted by the second light source, and vice versa, such that the light from the first light source is superimposed onto the light from the second light source following reflection/transmission at the partly transparent mirror.

9 Claims, 5 Drawing Sheets

U.S. PATENT DOCUMENTS 7,380,960 B2 * 6/2008 Chen ..... 362/236
7,542,206 B2 * 6/2009 Schuck et al. ..... 359/489.08
7,658,506 B2 * 2/2010 Dowling ..... 362/147
7,688,526 B2 * 3/2010 Lu et al. ..... 362/346
7,690,805 B2 * 4/2010 Kubota et al. ..... 362/97.3
7,874,697 B2 * 1/2011 Biebel et al. ..... 362/225
8,083,379 B2 * 12/2011 Schulz et al. ..... 362/300
2002/0191395 A1 * 12/2002 Fleury ..... 362/236
2006/0083023 A1 4/2006 Ayabe et al.
2006/0274421 A1 12/2006 Okamitsu et al.
2007/0064417 A1 3/2007 Hatanaka et al.
2011/0261565 A1 * 10/2011 Gerli et al. ..... 362/235

* cited by examiner

LIGHT OUTPUT DEVICE WITH PARTLY TRANSPARENT MIRROR

FIELD OF THE INVENTION

The present invention relates to a light output device, comprising: a first light source; a second light source; and a partly transparent mirror. The present invention also relates to a light output method.

BACKGROUND OF THE INVENTION

A light output device of the type mentioned by way of introduction is disclosed in the US-patent application US 2006/0274421 A1 (Okamitsu et al.). In particular, in relation to FIG. 1a in US 2006/0274421 A1, there is described a solid state light source comprising a pair of light emitting arrays. The light emitting arrays output light rays which pass directly to a target surface, whereas other rays produce a combined irradiance produced by an optical mixing element on which the other rays are incident. The optical mixing element may be a semi-reflective mirror which substantially splits the emission of the other rays into reflected rays and transmitted rays which are mixed such that they are superimposed on each other.

However, a problem with the solid state light source of FIG. 1a in US 2006/0274421 A1 is that the light rays which pass directly to the target surface contribute to an uneven mixing at the target surface.

SUMMARY OF THE INVENTION

It is an object of the present invention to at least partly overcome this problem, and to provide a light output device with improved mixing.

This and other objects that will be apparent from the following description are achieved by a light output device and method according to the appended independent claims.

According to an aspect of the present invention, there is provided a light output device, comprising: a first light source; a second light source; and a partly transparent mirror, wherein the partly transparent mirror, during operation of the device, receives substantially all light emitted by the first and second light sources, and reflects part of the light emitted by the first light source and transmits part of the light emitted by the second light source, and vice versa, such that the light from the first light source is completely superimposed onto the light from the second light source following reflection/transmission at the partly transparent mirror.

Since all light emitted by the first and second light sources hits the partly transparent mirror, perfect mixing may be achieved. Furthermore, no diffuser(s) need(s) to be added, which means that highly collimated beams can be provided.

In advantageous embodiments of the present invention, the partly transparent mirror is a semi-transparent or semi-reflective mirror (that is, about half of the incoming light is reflected, while the other half is transmitted), the first and second light sources are arranged symmetrically one on each side of the partly transparent mirror, and/or the first and second light sources have substantially identical radiation patterns.

Further, the first light source is preferably adapted to emit light having a first wavelength spectrum, whereas the second light source is adapted to emit light having a second wavelength spectrum different from the first wavelength spectrum. In this way, two different colors, or colored and white light, may advantageously be mixed.

Preferably, each of the first and second light sources comprises at least one light emitting diode (LEDs). The LEDs of each light source may be of the same or different colors. Benefits of LEDs include high efficiency, long useful life, etc. However, other light sources such as lasers, fluorescent lamps, TL-tubes, etc. could instead be used in some embodiments.

Also preferably, the present device further comprises collimating means adapted to at least partly collimate the light of the first and second light sources such that during operation substantially all the at least partly collimated light of the first and second light sources is incident on the partly transparent mirror.

In one embodiment, during operation of the device, the at least partly collimated light of the first and second light sources is incident on the partly transparent mirror such that a first and second mixed beam is produced, wherein the light output device further comprises a plane mirror for re-directing one of the first and second mixed beams in the direction of the other mixed beam. In this embodiment, the collimating may comprise two half compound parabolic concentrators (CPCs), one for each light source, though other collimating means could be used, like normal CPCs or Cassegrain collimators. By optimizing the angle of collimation and the angle between the collimating means and the partly transparent mirror, the size of the light output device may be minimized. In this embodiment, the device preferably comprises at least one lens adapted to focus the superimposed light, in order to beneficially regain lost etendue. Instead of a lens, a specially adapted mirror could be used to focus the light.

In another embodiment, the collimating means comprises two parabolic mirrors, wherein the partly transparent mirror is arranged between the two parabolic mirrors, and wherein the first light source is arranged on the optical axis of one of the parabolic mirrors between the one parabolic mirror and the focal point of the one parabolic mirror, and the second light source is arranged on the optical axis of the other parabolic mirror between the other parabolic mirror and the focal point of the other parabolic mirror. In this embodiment, no lens is needed, but the device preferably comprises a secondary collimating means adapted to collimate the superimposed light. The post-collimation after mixing has the advantage that the device remains small. Instead of the parabolic mirrors, other shapes could be used, like ellipsoids, facetted mirrors, etc.

In yet another embodiment, the device further comprises additional light sources, the light sources of the device being arranged in two rows, one row on each side of the partly transparent mirror, providing a linear light output device.

According to an aspect of the present invention, there is provided a light output method, comprising: by means of a partly transparent mirror, receiving substantially all light emitted by a first light source and a second light source; and by means of the partly transparent mirror, reflecting part of the light emitted by the first light source and transmitting part of the light emitted by the second light source, and vice versa, such that the light from the first light source is completely superimposed onto the light from the second light source following reflection/transmission at the partly transparent mirror. Advantages and features of the this aspect of the present invention are analogous to those of the above described aspect of the invention.

BRIEF DESCRIPTION OF THE DRAWINGS

These and other aspects of the present invention will now be described in more detail, with reference to the appended drawings showing currently preferred embodiments of the invention.

DETAILED DESCRIPTION

Figure 1:
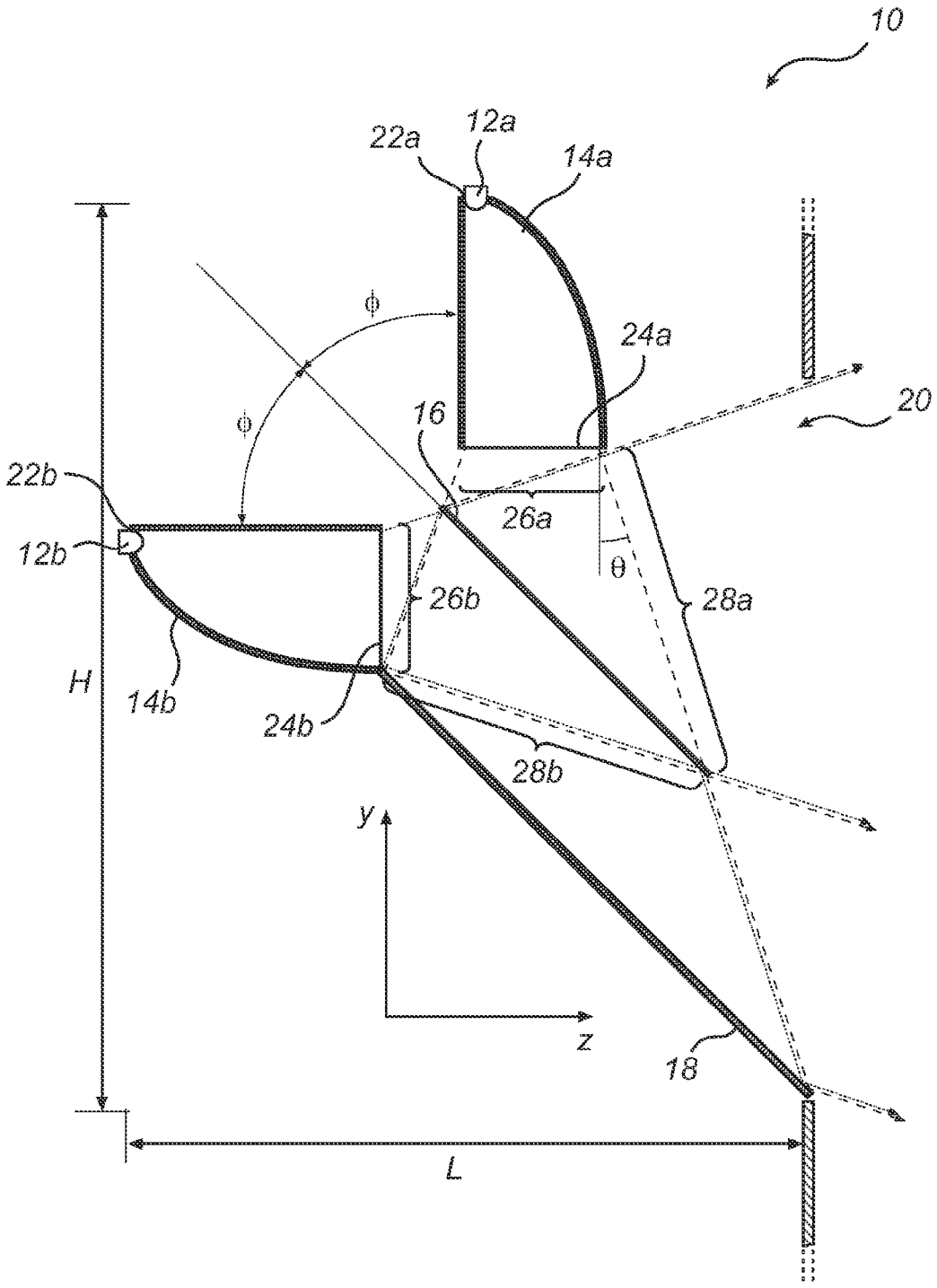
FIG. 1 is a schematic cross-sectional side view of a light output device according to an embodiment of the present invention.

FIG. 1 is a schematic cross-sectional side view of a light output device 10 according to an embodiment of the present invention.

The light output device 10 comprises two light sources, specifically two LEDs 12*a*, 12*b*, as well as two half-CPCs 14*a*, 14*b*, a semi transparent mirror 16, a plane mirror 18, and an exit aperture 20.

The LEDs 12*a*, 12*b* are of different colors (including white). The LED 12*a* may for instance be adapted to emit red light, and the other LED 12*b* may be adapted to emit green light, for mixing red and green light. The LEDs 12*a*, 12*b* may for instance be top-emitting LEDs. The two LEDs 12*a*, 12*b* have the same radiation patterns.

Figure 2:
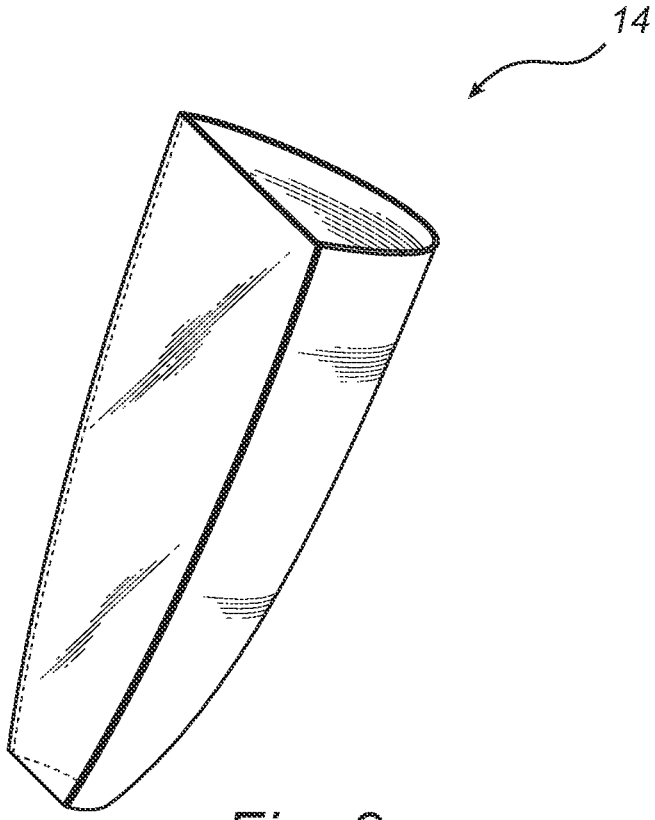
FIG. 2 is a perspective view of a half CPC of the device in FIG. 1.

A half-CPC is a collimator which consists of a CPC cut in half by a mirror. The function of the mirror may be achieved by means of (total) internal reflection. In FIG. 2, a perspective view a half-CPC is illustrated. The plane portion is the mirror, whereas the curved portion is half a CPC. A half-CPC does not have the same angular distribution as a CPC, but the maximum collimation angle is the same. In the present device, a half-CPC is preferably used instead of a CPC, because this allows the collimators to be placed closer together, which in turn reduces the size of the device 10. The half-CPCs 14*a*, 14*b* of the device 10 are of equal size and shape.

The semi-transparent mirror 16 generally transmits one half of incoming light and reflects the other half of incoming light, to produce mixed light comprising substantially equal amounts of light from each of the LED 12*a*, 12*b*. The semi transparent mirror 16 may beneficially be made up of a substrate with a 25% reflector on each side.

In the device 10, the LEDs 12*a*, 12*b* are located at the entrances 22*a*, 22*b* of the half CPCs 14*a*, 14*b*, as illustrated in FIG. 1, and the two half-CPCs 14*a*, 14*b* are arranged mirror-wise towards the semi transparent mirror 16. The half-CPCs 14*a*, 14*b* in FIG. 1 are placed so that the most diverging outgoing rays of one of the half-CPCs just miss the exit surface 24*a*, 24*b* of the other half-CPC, as seen from the radiation patterns 26*a*, 26*b*. Further, the exits surfaces 24*a*, 24*b* of the half-CPCs 14*a*, 14*b* are arranged at about 90 degrees in relation to each other, while is semi transparent mirror 16 is arranged at about 45 degrees in relation to the exits surfaces, as seen from the perspective of FIG. 1. Further, with respect to the radiation patterns 26*a* (dashed lines), 26*b* (dotted lines) of the light sources (following collimation by the half-CPCs 14*a*, 14*b*) and the placement of the light sources (and the half-CPCs) and the semi transparent mirror 16, the semi transparent mirror 16 is sized such all light emitted by the light sources (as shaped by the half-CPCs 14*a*, 14*b*) hits the semi transparent mirror 16. Further, the plane mirror 18 is arranged parallel to the semi transparent mirror 16, one end of the plane mirror 18 adjoining one end of one of the exit surfaces 24*a*, 24*b*, as illustrated in FIG. 1. The plane mirror 18 is sized such that the light from 14*a* transmitted through the mirror 16 and the light from 14*b* reflected by the mirror 16 hits the plane mirror 18, at least once.

During operation of the light output device 10, light emitted by the LEDs 12*a*, 12*b* is at least partly collimated by the half-CPCs 14*a*, 14*b*, resulting in radiation patterns 26*a*, 26*b*. All light emitted by the LEDs 12*a*, 12*b* hits the semi transparent mirror 16. About half of the light emitted by the LED 12*a* is reflected by the semi transparent mirror 16, while the other half is transmitted through the semi transparent mirror 16. Likewise, about half of the light emitted by the LED 12*b* is reflected by the semi transparent mirror 16, while the other half is transmitted through the semi transparent mirror 16. Due to the above described arrangement of the device 10, the light emitted by the LED 12*a* and reflected by the semi transparent mirror 16 is perfectly superimposed on the light emitted by the LED 12*b* and transmitted through the semi transparent mirror 16, forming mixed beam 28*a*. Likewise, the light emitted by the LED 12*a* and transmitted through the semi transparent mirror is perfectly superimposed onto the light emitted by the LED 12*b* and reflected by the semi transparent mirror, forming mixed beam 28*b*. The mixed beam 28*a* is immediately directed towards the exit aperture 20 of the device 10. The mixed beam 28*b* on the other hand is first incident on the plane mirror 18, which plane mirror 18 redirects the mixed beam in the same direction as the mixed beam 28*a* towards the exit aperture 20, as illustrated in FIG. 1. Due to the above described arrangement of the device 10, the beam 28*b* exits the aperture 20 next to the beam 28*a*. The exit aperture 20 is preferably sized and located such that substantially all light of the mixed beams 28*a*, 28*b* may be outputted from the device 10.

Indeed, in the device 10, the light sources (LEDs 12*a*, 12*b*) of different colors are perfectly overlapped by making virtual light sources with the help of mirror images. In other words, each light source appears to be placed at two different positions. Simulations show that the present device 10 perfectly mixes light.

For the light output device 10, besides the size of the collimator (i.e. the half-CPCs 14*a*, 14*b*), the angle of collimation ($\theta$), and the angle ($\phi$) between the half-CPCs 14*a*, 14*b* and the semi transparent mirror 16 determine the size of the various elements in the device 10, and therefore the size of the device 10. The length L×height H product can be optimized. The length L and height H are indicated FIG. 1. For $\theta$=24° and $\phi$=45° this product is minimal. This product is proportional to the square of the entrance radius of the CPCs 14*a*, 14*b*. For an entrance radius of 1.5 mm, the device 10 will have a length and height of 29 mm and 28 mm respectively. The depth (x-direction in FIG. 1) of the device 10 is 26 mm.

Further, the rays can be collimated in the depth direction. In the present embodiment, no collimator is applied in the depth direction, though such a collimator could be added. If no collimator is placed to collimate the rays in the depth direction, then device volume is minimal for $\theta$32 24°. Collimating the light in the depth direction will reduce the size of the exit aperture, as well as reduce the increase of etendue.

Also in the present embodiment, etendue is minimal for $\phi$=45° and for $\theta$ as small as possible. For $\theta$=24° and $\phi$=45°, the etendue at the exit aperture 20 is about thirty times the etendue at the entrance the half-CPCs. The etendue is larger because the rays keep diverging as they go through the device 10. Therefore, preferably a lens (not shown) is placed at the exit aperture 20 or at each exit surface 24*a*, 24*b* of the other half-CPCs 14*a*, 14*b*. This lens narrows the divergence of the beam(s), and hence reduces the etendue.

Figure 3:
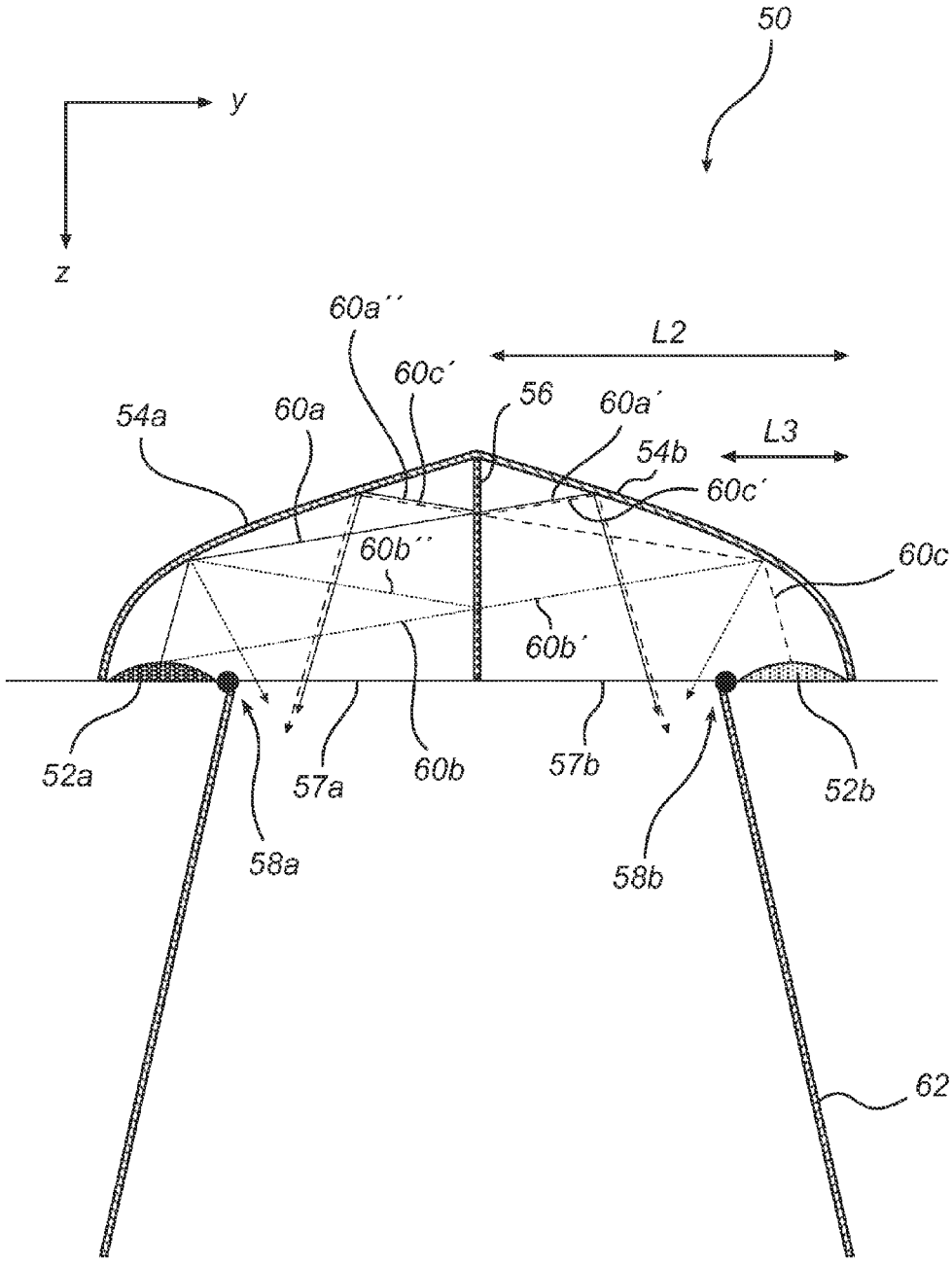
FIG. 3 is a schematic cross-sectional side view of a light output device according to another embodiment of the present invention.
Figure 4:
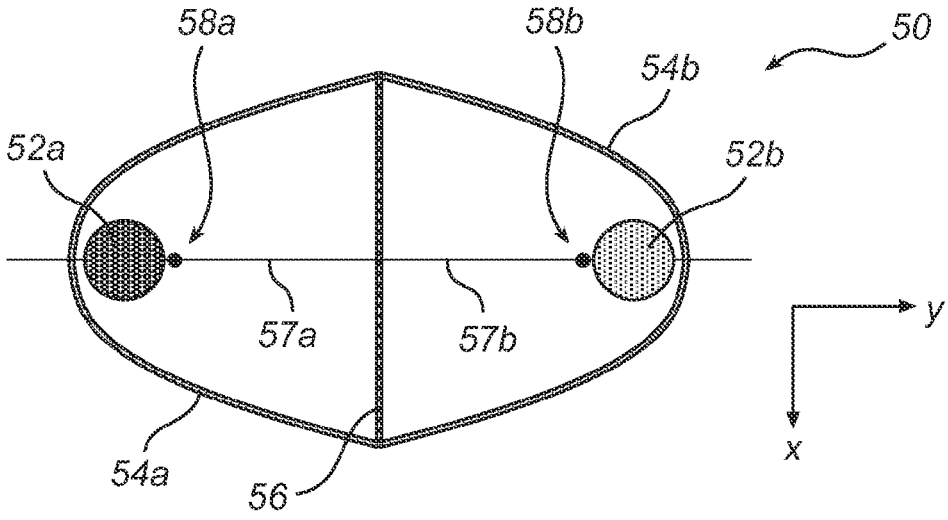
FIG. 4 is a schematic bottom view of the device in FIG. 3.

FIG. 3 is a schematic cross-sectional side view of a light output device 50 according to another embodiment of the present invention, and FIG. 4 is a schematic bottom view of the device of FIG. 3

The light output device 50 comprises two light sources, specifically two LEDs 52*a*, 52*b*, as well as two parabolic imaging collimators or parabolic mirrors 54*a*, 54*b*, and a semi transparent mirror 56.

The LEDs 52*a*, 52*b* are of different colors (including white), and may for instance be top-emitting LEDs. The two LEDs 52*a*, 52*b* have the same radiation patterns. The parabolic mirrors 54*a*, 54*b* are of equal size and shape. The semi transparent or semi reflective mirror 56 is similar to the semi transparent mirror 16 described above.

The semi transparent mirror 56 is placed between the two opposed, adjoining parabolic mirrors 54*a*, 54*b*, as illustrated in FIGS. 3 and 4. The semi transparent mirror 56 completely "covers" the passage between the two parabolic mirrors 54*a*, 54*b*. The LED 52*a* is placed on the optical axis 57*a* of the parabolic mirror 54*a*, between the parabolic mirror 54*a* and its focal point 58*a*. The LED 52*a* is generally oriented such that some emitted light is directed towards the parabolic mirror 54*a*, while the rest of the emitted light is directed directly towards the semi transparent mirror 56. Likewise, and symmetrically, LED 52*b* is placed on the optical axis 57*b* of the parabolic mirror 54*b*, between the parabolic mirror 54*b* and its focal point 58*b*, and is generally oriented such that some emitted light is directed towards the parabolic mirror 54*b*, while the rest of the emitted light is directed directly towards the semi transparent mirror 56. Light from the LEDs directed directly towards the semi transparent mirror will also be focused in between the two LEDs.

During operation of the device 50, an exemplary light ray 60*a* (solid line) from the LED 52*a* that hits the parabolic mirror 54*a* before reaching the semi transparent mirror 56 is re-directed by the parabolic mirror towards the other parabolic mirror 54*b*. At the semi transparent mirror 56, the ray 60*a* is split into ray 60*a*' transmitted through the semi transparent mirror 56 and ray 60*a*" reflected by the semi transparent mirror 56. The transmitted ray 60*a*' is then re-directed or projected by the parabolic mirror 54*b* towards the optical axis 57*b*. Likewise, the reflected ray 60*a*" is re-directed or projected by the parabolic mirror 54*a* towards the optical axis 57*a*. Another exemplary ray 60*b* (dotted line) from the LED 52*a* that hits the semi transparent mirror 56 directly is split into ray 60*b*' transmitted through the semi transparent mirror 56 and ray 60*b*" reflected by the semi transparent mirror 56, which rays 60*b*', 60*b*" also are re-directed and projected towards the optical axes 57*b*, 57*a*, respectively. With suitably chosen dimensions, all light is projected between the light sources.

Analogous to this, the light which is emitted from the other light source 52*b* is also directed between both light sources. Since the two parabolic mirrors 54*a*, 54*b*, as well as the two LEDs 52*a*, 52*b*, are on each others mirror images as imaged by the semi transparent mirror 56, the rays that hit the semi transparent mirror 56 on the one side are overlayed on the rays which hit the semi transparent mirror 56 from the other side. Therefore, the rays reflected by the semi transparent mirror 56 are also projected between the two light sources. For instance, an exemplary light ray 60*c* (dashed line) emitted from the LED 52*b* is split by the semi transparent mirror 56 into transmitted ray 60*c*' and reflected ray 60*c*", the ray 60*c*' being superimposed onto the ray 60*a*" and the ray 60*c*" being superimposed on the ray 60*a*'.

Indeed, in the device 50, the light sources (LEDs 52*a*, 52*b*) of different colors are perfectly overlapped by making virtual light sources with the help of mirror images. In other words, each light source appears to be placed at two different positions, like in the device 10. However, in the device 50, imaging optics (e.g. the parabolic mirrors 54*a*, 54*b*) are used to keep the device small.

Further, in the device 50, the place of the LEDs 52*a*, 52*b* relative to the position of the focus 58*a*, 58*b* of the parabolic mirrors 54*a*, 54*b* and the length L2 of the parabolic mirrors 54*a*, 54*b* determines where the rays leave the device 50. For optimal output, the dimensions of the device 50 should be chosen such that all light is projected between the two LEDs 52*a*, 52*b*, on a area as small as possible. Also the total size of the device 50 should be minimal. When each LED lies between the parabolic mirror and its focal point and the total length L2 of the parabolic mirror 54*a*, 54*b* is three times the focal length L3, the requirements are met. L2 and L3 are indicated in FIGS. 3 and 4. Theoretically, a parabolic mirror length L2 of 3/2 times the focal length L3 is also sufficient, however in practice it is not.

Figure 5:
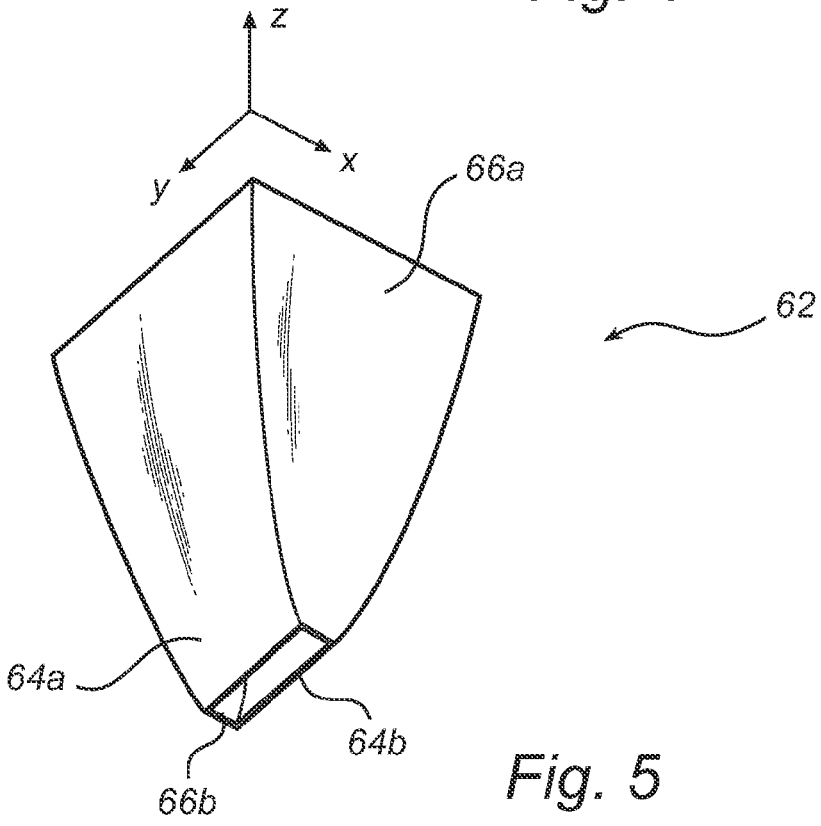
FIG. 5 is a perspective view of an optional collimator for the device in FIGS. 3 and 4.

In the light output device 50 described so far, at the exit surface of the parabolic mirrors 54*a*, 54*b*, the superimposed light is somewhat collimated in the y-direction, and not collimated in the x-direction. To collimate the light in two directions, the device may further comprise a secondary collimator (not shown in FIG. 4 for the sake of clarity) arranged at the exit surface of the parabolic mirrors 54*a*, 54*b*. The shape of an exemplary secondary collimator 62 is shown in FIG. 5. The secondary collimator 62 comprises opposite parabolic mirrors 64*a*, 64*b* linked by opposite plane mirrors 66*a*, 66*b*. During operation, light in the x-direction is collimated using the parabolic mirrors 64*a*, 64*b*, whereas light in the y-direction is collimated using the plane mirrors 66*a*, 66*b*. The choice of the different shapes for the different directions is because the light coming out of the parabolic mirrors 54*a*, 54*b* is already partially collimated in one direction and because the collimator input irradiance distribution has a elliptical shape.

Instead of the secondary collimator 62, other optical means could be used. For instance, an asymmetric decollimator which shrinks the size of the spot in the y-direction could be used, though the beam divergence will increase. This will make the angular distribution more symmetric and the spot more round. After the decollimation, a symmetric collimator can be placed to obtain the desired beam divergence.

An exemplary device 50 is designed to have a circular input area of 2.55 mm in diameter for each light source 52*a*, 52*b*. For these input areas, the device 50 has a length of 40 mm, and a output area of 22×20 mm. For this size, the outgoing beam has 80% of the flux contained within outgoing angles of ±20° and ±10°. The etendue of the beam including 80% of the light is two times the etendue in when both LEDs are lit. This etendue loss of a factor 2 is caused by the secondary collimator, but is not fundamental.

Simulations show that the device 50 provides perfect color mixing. Compared to the device 10 of FIGS. 1-2, the device 50 features a great reduction of etendue increase, and there is also a volume reduction. For both devices the mixing quality is the same.

Figure 6:
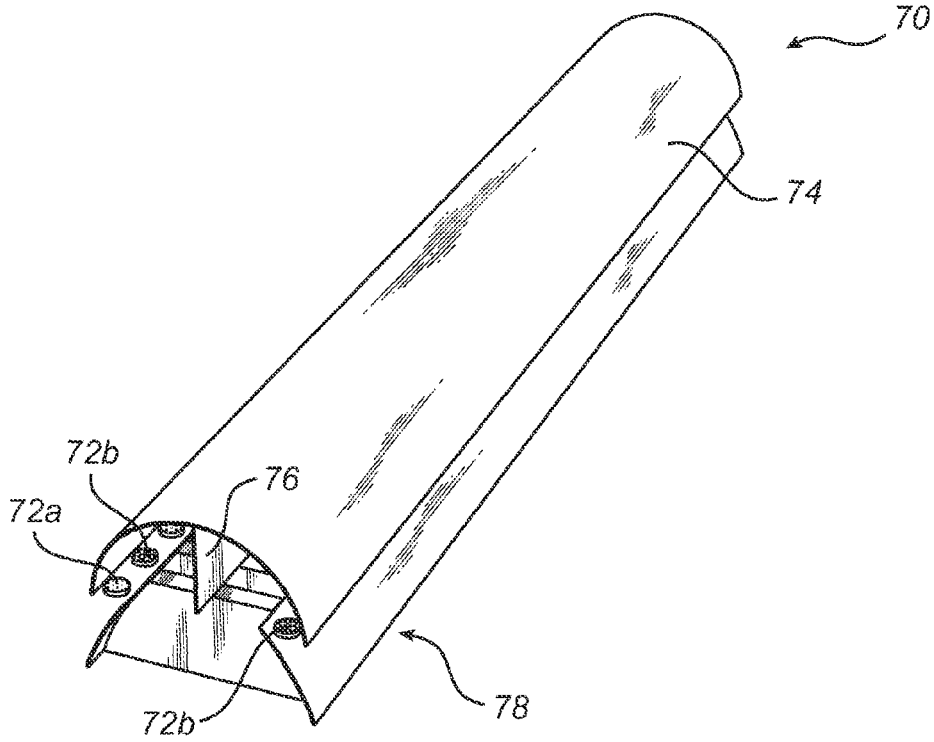
FIG. 6 is a schematic perspective view of a light output device according to yet another embodiment of the present invention.
Figure 7A:
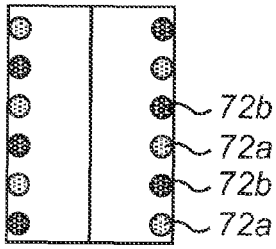
FIG. 7*a* is a schematic bottom view of the device in FIG. 6.
Figure 7B:
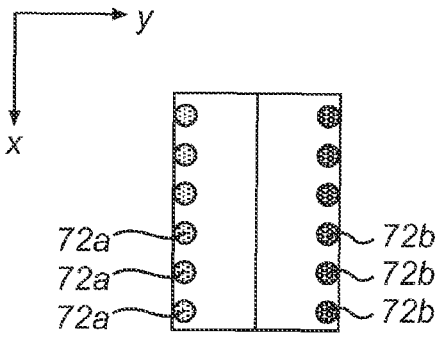
FIG. 7*b* is a schematic bottom view of a variant of the device in FIGS. 6 and 7*a*.

FIG. 6 is a schematic perspective view of a light output device 70 according to yet another embodiment of the present invention. The device 70 comprises LEDs, a parabolic mirror structure 74, a semi transparent mirror 76, and secondary collimating means 78. The cross-section of the device 70 is similar to that of the light output device 50, but the device 70 comprises additional LEDs. The LEDs are arranged in two rows in the x-direction. The device 70 is like several device 50 placed after each other in the x-direction, but with a common parabolic mirror structure 74 and semi transparent mirror 76. The LEDs comprise LEDs 72*a* adapted to emit light having a first color, and LEDs 72*b* adapted to emit light having a second, different color (or white light). Preferably, the two types of LEDs are placed in an alternating arrangement, as illustrated in FIG. 7*a*. Alternatively, all LEDs 72*a* of the first color are arranged in one of the rows, and all LEDs 72*b* of the second color or white are arranged in the other row, as illustrated in FIG. 7*b*. In the device 70, the two rows of LEDs could be replaced by two different TL tubes.

Figure 8:
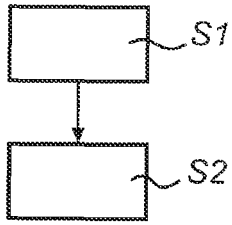
FIG. 8 is a flow chart of a light output method according to the present invention.

FIG. 8 is a flow chart of a light output method according to the present invention, as performed for instance in the above described devices, the method comprising the steps of: by means of a partly transparent mirror, receiving (step S1) substantially all light emitted by a first light source and a second light source; and by means of the partly transparent mirror, reflecting part of the light emitted by the first light source and transmitting part of the light emitted by the second light source, and vice versa (step S2), such that the light from the first light source is completely superimposed onto the light from the second light source following reflection/transmission at the partly transparent mirror.

Applications of the present device and method include, but are not limited to, spot lights for lighting or illumination, as the present device fulfills demands for spot lights, including that producing a very small beam, having a small volume, and having a small exit diameter. Other applications include down lights, stage lights, microscope illumination, etc.

The person skilled in the art realizes that the present invention by no means is limited to the preferred embodiments described above. On the contrary, many modifications and variations are possible within the scope of the appended claims.

For example, more than one LED could be used in each light source. For instance, for mixing cold and warm white together, a warm white LED and a cold white LED can be placed at each entrance or input of the collimating means, e.g. one above the other. The top position at the one entrance should be the warm white, while the top position at the other entrance should be the cold white, in such a way that a mirror image of a cold white will always appear on top of a warm white LED, and visa versa.

Also, instead of only two colors, the present devices could include more colors, e.g. by placing two semi transparent mirrors in a cross configuration, and adjusting the incoming angles of the light such that the light is guaranteed to hit both semi transparent mirrors. Another way to provide more than two colors is by placing two devices in series.

The invention claimed is:

1. A light output device, comprising:

a light exit aperture;

a curved mirror;

a plurality of longitudinally extending first light sources;

a plurality of longitudinally extending second light sources;

said plurality of first light sources and second light sources positioned such that light emitted by both said first light sources and said second light sources is directed towards said curved mirror and away from said light exit aperture;

a partly transparent mirror projecting from said curved mirror, said partly transparent mirror positioned substantially between a first row of said first light sources and a second row of said second light source; and a collimator arranged at the light exit aperture for at least partly collimating the light from the first and second light sources;

wherein, during operation, substantially all the light from the first and second light sources is incident on the partly transparent mirror, the partly transparent mirror reflecting part of the light emitted by the first light source and transmitting part of the light emitted by the second light source, and vice versa, such that the light from the first light source is superimposed onto the light from the second light source following reflection/transmission at the partly transparent mirror, wherein the collimator receives reflected light from both said first and second light sources through the light exit aperture.

2. A light output device according to claim 1, wherein the plurality of first and second light sources are arranged symmetrically on each side of the partly transparent mirror.

3. A light output device according to claim 1, wherein the plurality of first and second light sources have substantially identical radiation patterns.

4. A light output device according to claim 1, wherein the plurality of first light sources is adapted to emit light having a first wavelength spectrum, and wherein the plurality of second light sources is adapted to emit light having a second wavelength spectrum different from the first wavelength spectrum.

5. A light output device according to claim 1, wherein each of the plurality of first and second light sources comprises at least one light emitting diode.

6. A light output device according to claim 1, wherein during operation the at least partly collimated light of the first and second light sources is incident on the partly transparent mirror such that a first and second mixed beam is produced, the light output device further comprising a plane mirror for re-directing one of the first and second mixed beams in the direction of the other mixed beam.

7. A light output device according to claim 1, wherein the-curved mirror comprises two parabolic mirrors, the partly transparent mirror is arranged between the two parabolic mirrors, and the plurality of first light sources is arranged on the optical axis of one of the parabolic minors between the one parabolic mirror and the focal point of the one parabolic mirror, and the other parabolic mirror and the focal point of the other parabolic mirror.

8. A light output device according to claim 7, further comprising a secondary collimating means adapted to collimate the superimposed light.

9. A light output device, comprising:

a longitudinally extending curved collimating reflector having a first end and a second end;

a row of longitudinally extending first LEDs positioned at said first end of said curved reflector and emitting light into said reflector and away from a light exit aperture;

a row of longitudinally extending second LEDs positioned at said second end of said curved reflector and emitting light into said reflector and away from said light exit aperture;

a partly transparent mirror depending from said curved reflector and interposed between said row of first LEDs and said row of second LEDs;

wherein said mirror receives substantially all of the light emitted by said row of first LEDs and said row of second LEDs and reflecting part of the light emitted by the first row of LEDs and transmitting part of the light emitted by the second row of LEDs and reflecting part of the light emitted by the second row of LEDs and transmitting part of the light emitted by the first row of LEDs;

such that light emitted by the first row of LEDs is superimposed onto the light from the second row of LEDs at said light exit aperture.

* * * * *